US006572299B1

(12) United States Patent
Brennan

(10) Patent No.: US 6,572,299 B1
(45) Date of Patent: Jun. 3, 2003

(54) WRITING INSTRUMENT HAVING ABRASIVE SURFACE

(76) Inventor: Patricia Brennan, 9 Oak Ridge Rd., Caldwell, NJ (US) 07006

( * ) Notice: Subject to any disclaimer, the term of this patent is extended or adjusted under 35 U.S.C. 154(b) by 0 days.

(21) Appl. No.: 09/922,889

(22) Filed: Aug. 6, 2001

(51) Int. Cl.[7] ..... B43K 29/00

(52) U.S. Cl. ..... 401/195; 401/52; 132/75.6; 132/75.3

(58) Field of Search ..... 401/195, 52; D28/59; 132/75.6, 75.3, 73

(56) References Cited

U.S. PATENT DOCUMENTS 587,243 A * 7/1897 Sloan ..... 132/75.6
2,841,156 A * 7/1958 Herald ..... 132/73.5
3,419,336 A * 12/1968 Kirk ..... 401/111
5,090,427 A * 2/1992 Sherts ..... 132/75.6

* cited by examiner

*Primary Examiner*—David J. Walczak
(74) *Attorney, Agent, or Firm*—Frommer Lawrence & Haug; Thomas J. Kowalski

(57) ABSTRACT

A writing instrument where an abrasive strip or strips is provided formed substantially along the length of the main body of the writing instrument. There may be a single strip of abrasive material or a plurality of strips of abrasive material, preferably wherein each of the strips has a differing degree of abrasiveness. The external surface may be a variety of configurations, however, one is a square configuration wherein the differing abrasive surfaces are located along opposite faces of the square. A further writing instrument has a slotted external surface where the abrasive strip may be slid into the slotted section and secured in the operative position.

9 Claims, 1 Drawing Sheet

WRITING INSTRUMENT HAVING ABRASIVE SURFACE

BACKGROUND OF THE INVENTION

The present invention relates to a writing instrument, and more particularly, to a writing instrument that has associated therewith, one or more abrasive surfaces that are adapted to be usable for shaping fingernails.

There are, of course, various implements that are used for shaping finger nails, many of which are simply nail files and have no other useful purpose. As such, those devices are simply carried and used by themselves. On the other hand, there are other devices that have been disclosed and which are combination devices such that the device not only comprises a nail file but may also have an additional purpose. Such combination devices are of an added convenience to the user, particularly if the other use of the device is also a use that would normally entail a device that is carried on one's person such as, for example, in a woman's purse.

Accordingly such combination devices can be employed to combine two or more functions in a single device. One of such combination devices is where the device combines the functions of a writing instrument while also providing the convenience and utility of being usable for shaping nails, that is, of being usable as a nail file.

An example of a combination device that combines the functions of a writing instrument and a nail shaping device is shown and described in U.S. Pat. No. 5,090,427 of Sherts. In the Sherts patent, however, there is disclosed a writing instrument that includes a means for pushing back the cuticle of the finger as well as having an abrasive strip that can be used for shaping of the fingernails. A problem with the Sherts device, however, lies in the location of the cuticle pusher and the abrasive strip. Both functions are located on the cap of the writing instrument and, as such, the cap may become disengaged from the main body of the instrument during use or, alternatively, can be disengaged to carry out its fingernail shaping function and inadvertently misplaced so that the cap is not replaced on the body of the writing instrument. In addition, of course, the overall length of the strip of abrasive material, being confined to the cap of the writing instrument, is somewhat limited and, as such, the user cannot get a full stroke or full effective use of the nail shaping function.

In additional combination devices of the type discussed, there has also been disclosed, a clip attachment for a pocket carried device, such as a pen in U.S. Pat. No. 1,478,049. However, again, the length of the abrasive surface usable to carry out the shaping of a fingernail is quite limited due to the physical dimensions of a clip employed with a pen and its alternate function of clipping the pen to the pocket of a user.

Other examples of such combination devices that have also been disclosed include Design Pat. No. 257,181 of Brown and U.S. Pat. No. 2,841,156 of Herald, both of which devices are also limited in overall length since they also rely on the clip of a pen for the location of the abrasive strip and thus suffer from the same drawbacks as the previously discussed combination devices. In addition, of course, such constructions severely limit the width of the strip of abrasive material that can be associated with the clips used with pens.

In addition to the problem or deficiency of the aforedescribed prior art devices, relative to the limited length of the abrasive strip, by utilizing the clip, cap or other relatively small component of the writing instrument, the device is limited in the width of the abrasive material and cannot physically provide more than one relatively narrow strip of such material. Thus, with any of these combination devices, it would not be practical to include more than one strip of the abrasive material, such as would be advantageous of one were to desire more the one abrasive strip so as to have differing degrees of abrasiveness, that is, if one were to desire a device having one strip of a material that is a course abrasive and a second strip of a material with a finer abrasiveness on the same writing instrument.

It would therefore be advantageous to have a writing instrument that can be used with a longer surface or strip of abrasive material, but in addition, can have the capability, dimensionally, to provide more than one abrasive surface with differing degrees of abrasive materials so that the user can have additional flexibility and functionality in utilizing the nail shaping function while not detracting from the writing capability of the writing instrument.

SUMMARY OF THE INVENTION

The present invention provides a writing instrument combined with a nail shaping function that overcomes the problems and deficiencies of the aforedescribed prior art combination devices. Thus, in accordance with the present invention, a combination writing instrument and nail shaping function is provided in which the writing instrument comprises a main body and where an abrasive strip is provided along that main body of the writing instrument and therefore, the abrasive strip can be extended in length over those uses where the abrasive strip is oriented on the clip or cap of the writing instrument.

The particular writing instrument may be a pencil, ink pen, ball point pen, or the like and is preferable a ball point. As is normal with such instruments, the writing substance is located within the main body of the instrument and, as stated, can be either pencil lead, a normal liquid ink or an ink cartridge for a ball point pen. The exterior surface of the body of the writing instrument, can also be of a variety of configurations, including square, rectangular, oval, round or other geometrical or non-geometrical shapes.

In one embodiment, there are a plurality of abrasive strips located on the exterior surface of the writing instrument, preferably two of such strips, and, in can case of a square external configuration, the two abrasive strips preferably are located on opposite sides of the square configuration. With other external surface configurations, the multiple or plurality of such strips may be contiguous to each other or may be separated by some non-abrasive surface.

As is also preferred in the present invention, where two or more abrasive strips are located on the external surface of the writing instrument, the individual strips may have differing degrees of abrasiveness, that is, one of the strips may have a course abrasive material while the other abrasive material may be comprised of a finer abrasive material so that the user can initially shape the fingernail with the courser material and finish the shaping of the fingernail with the finer abrasive material.

The abrasive strip itself, can be provided in the form of a strip that is affixed to the exterior surface of the writing instrument by means of an adhesive or can be actually molded into or pressed into the external plastic material of the writing instrument and thus embedded into that external surface. As a further embodiment, the strip of abrasive material may be separately provided and slipped into a special formed external slotted surface on the external surface thereof, and then further affixed thereto by an adhesive.

Thus, as explained, with the present invention, there is provided a writing instrument having a strip or strips of an abrasive material located on the exterior surface of the main body of the writing instrument and therefore can be considerably longer in overall length of the abrasive strip as compared to the prior art examples where the abrasive material is applied to a limited area on the instrument such as the cap of a pen or a clip. In addition, with the additional external surface area that is therefore available on the present writing instrument, there can be provided a plurality of strips of the abrasive material and thereby give the user additional flexibility in being able to have a plurality of strips of abrasive material having differing degrees of abrasiveness. Further, as will be seen, the external surface of the main body of the writing instrument may be specially configured so as to add the abrasive strip or strips thereto easily and with minimal additional expense of manufacture.

Other features of the writing implement will become apparent in light of the following detailed description of a preferred embodiment thereof and as illustrated in the accompanying drawings.

DETAILED DESCRIPTION OF THE INVENTION

Figure 1A:
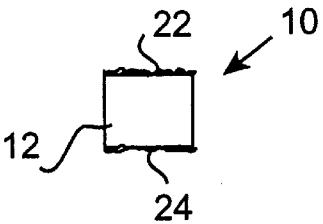
FIG. 1A is a cross sectional view of the embodiment of FIG. 1.
Figure 1:
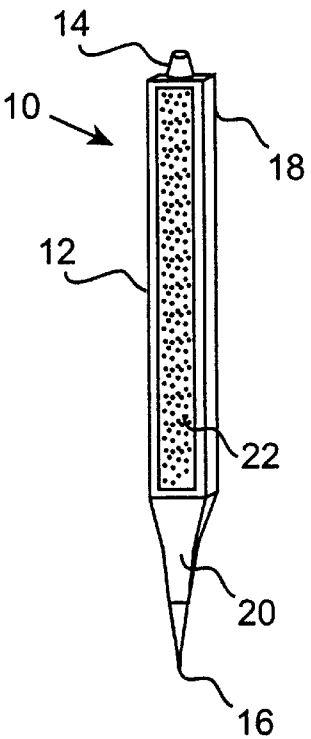
FIG. 1 is a perspective view of a writing instrument constructed in accordance with the present invention.

Referring now to FIG. 1, there is shown a perspective view of a writing instrument 10 constructed in accordance with the present invention. In the embodiment of FIG. 1, it can be seen that the writing instrument 10 comprises a main body 12 having a predetermined external surface having a square configuration. As is normal for certain of such writing instruments 10, this embodiment is typical of a ball point pen and therefore includes a button 14 located on the writing instrument 10 in order to operate the device and to move the point 16 of the ball point cartridge contained within the main body 12 from an exposed position as shown in FIG. 1 to a retracted position as is conventional with such writing instruments. Accordingly, although a ball point pen embodiment is shown and described hereinafter with respect to FIG. 1, it will be seen that the writing instrument 10 may be any other type of similar writing instrument, including, but not limited to, fountain pen or a pencil.

As will also be referenced, the top end of the writing instrument will be referred to as the proximal end 18 where the end of the writing instrument 10 that contacts the material for writing thereon, and where the point 16 is located will be referred to as the distal end 20. As therefore can be seen, the distal end 20 narrows down in the direction of the point 16 and may become generally circular in cross section in order to be more convenient and comfortable for the user to properly grip the writing instrument 10 in utilizing the same.

Along the main body 12 of the writing instrument 10 there is provided an abrasive strip 22 that is located on one of the faces of the square configured outer surface of the writing instrument 10 and the strip 22 is, in length, substantially along the full length of that main body 12. The actual abrasive strip 22 may be applied or provide onto the external surface of the main body 12 by a variety of means, one of which is to embed the abrasive material into the external surface or, alternatively, the abrasive material may be adhered to the external surface by the use of an adhesive that affixes that abrasive material to the external surface thereof. In any event, the abrasive strip 22 is shown in the FIG. 1 along one surface, however as shown in FIG. 1A, there can be a further abrasive strip 24 provided on the opposite side of the square configuration such that the writing instrument 10 has a plurality of abrasive strips 22, 24 along the main body 12 thereof.

The actual material used for the abrasive strips 22, 24 may be emery as is currently used in nail files and the like and, in the preferred embodiment, the abrasiveness of the abrasive strips 22, 24 is of a differing degree, that is, the abrasive strip 22 may be of a course abrasive emery material while the abrasive strip 24 may be of a finer abrasive material so that the user can carry out gross shaping of the fingernail by first using the abrasive strip 22 and then finishing off the nail by the more smother abrasive strip 24.

As can be seen, by locating the abrasive strips 22, 24 on or along substantially the entire length of the main body 12 of the writing instrument 10, the user has a better grip on the writing instrument 10 to properly shape the fingernails without fear of the abrasive strip 22 coming loose, being misplaced and the like and also has the further advantage, as shown, that the use of the full, main body 12 also comprises the additional surface area of the external surface of the writing instrument 10 so as to enable the user the potential of a plurality of strips of abrasive material.

Figure 2A:
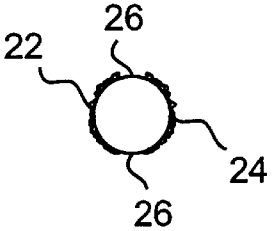
FIG. 2A is a cross sectional view of the embodiment of FIG. 2.
Figure 2:
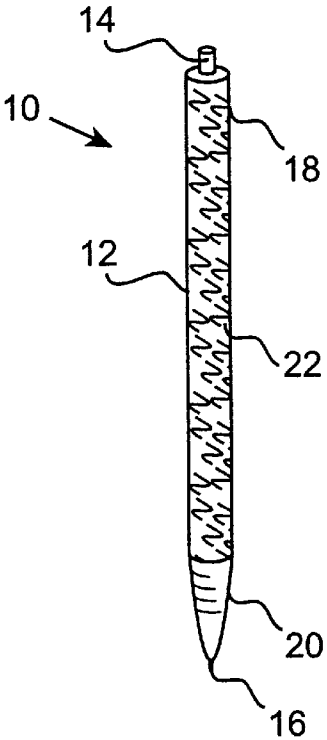
FIG. 2 is a perspective view of a further embodiment of the present invention.

Turning now to FIG. 2, there is shown a perspective view of a further embodiment of the present invention and where the writing instrument 10, using the same reference numbers as FIG. 1 for similar components, has a circular external surface or configuration, however, again, the abrasive material strip 22 is formed or located substantially along the length of the main body 12 of that writing instrument 10. Again, although the embodiment of FIG. 2 may comprise the abrasive strip 22 to fully encircle the external surface thereof, turning to FIG. 2A, there can be seen a cross sectional view of the FIG. 2 embodiment where there two abrasive strips 22, 24 formed on that external cylindrical surface, and where there may be a non-abrasive surface 26 located intermediate the abrasive strips 22, 24 to separate those strips for the convenience in using the writing instrument 10 for the shaping of the fingernails.

Figure 3:
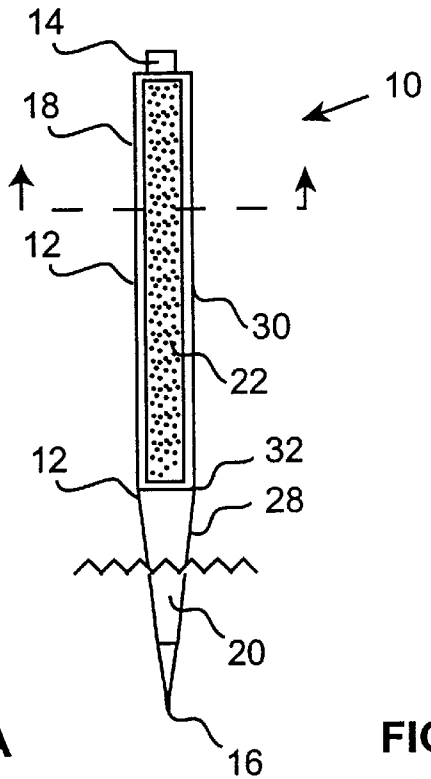
FIG. 3 is a side view, partially broken away, showing a still further embodiment of the present invention.
Figure 3A:
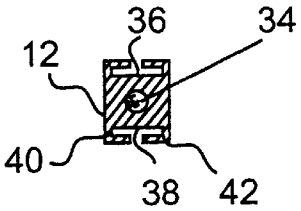
FIG. 3A is a cross sectional view of the embodiment of FIG. 3.

Finally, turning to FIGS. 3 and 3A, there are shown, a perspective view and a cross sectional view, respectively of an alternative embodiment of the present invention. In FIG. 3 and 3A, there can be seen a generally square configuration of the external surface of the main body 12 of the writing instrument 10. In this embodiment the main body 12 is comprised of a first housing 28 and a second housing 30 that can be affixed together by means of a threaded connection, such as at 32, it being noted that in any of the embodiments that have been discussed, the main body 12 can be made up of a plurality of components, principally two components, that are affixed together and which enables the convenient replacement of the ink cartridge when the writing instrument is a ball point pen.

In this embodiment, there is a hollowed out elongated opening 34 formed in the main body 12 of the writing instrument within which the ink cartridge is adapted to be disposed and there are slotted sections 36 and 38, each of which is formed by a pair of oppositely facing slot 40, 42 and which enable an emery board or other abrasive strip of material to be slid into the slotted sections 36, 38 in the construction of the writing instrument 10. With this embodiment, therefore, the slotted sections 36, 38 allow the manufacturer or user to slide the strip of abrasive material into one or both of the slotted sections 36, 38 such that the abrasive strips can then be affixed within the slotted sections 36, 38 by means of an adhesive or the strip or strips of adhesive material may be dimensioned so as to be force fit into the slotted sections 36, 38 and thus be retained therein by means of friction. With this embodiment, it is also possible for the abrasive strip or strips to be removed for replacement if the abrasive strip were to wear out and a new abrasive strip can be fitted into the writing instrument 10. Thus, the abrasive strip and main body can be a writing instrument kit.

While an illustrative embodiment of the invention has been described above, it is, of course, understood that various modifications will be apparent to those of ordinary skill in the art. Such modifications are within the spirit and scope of the invention, which is limited and defined only by the appended claims.

What is claimed is:

1. A writing instrument comprising:

a main tubular body having an external surface of a rectangular configuration, wherein at least one external surface of said rectangular configuration has a slotted section formed therein for removably receiving a strip of an abrasive material, and said main tubular body has a proximal end and a distal end having a writing point, and a portion towards the distal end that a user grips when using the writing instrument for writing, and the strip of an abrasive material in the slotted section;

wherein the abrasive material is not located on a cap or clip of the writing instrument.

2. A writing instrument as defined in claim 1 where said at least one slotted section is formed by a pair of inwardly facing, oppositely disposed slots formed in said external surface of said writing instrument.

3. A writing instrument as defined in claim 1 where said at least one slotted section comprises two slotted sections, each of which is formed on opposite faces of said rectangular configuration of said external surface.

4. A method of making a writing instrument having a strip of abrasive material incorporated therein, said method comprising the steps of:

providing a writing instrument having a main body having an external surface having at least one slotted section formed thereon, wherein the main body has a portion that a user grips when using the writing instrument for writing, and the slotted surface is not located on a cap or clip of the writing instrument;

providing a strip of an abrasive material;

inserting the strip of abrasive material into the slotted section formed on the external surface of said main body; and securing the strip of abrasive material within the slotted section.

5. A method of making a writing instrument as defined in claim 4 wherein said step of providing a strip of an abrasive material comprises providing an emery board.

6. A method of making a writing instrument as defined in claim 4 wherein said step of securing the strip of abrasive material comprises applying an adhesive to secure the strip of abrasive material with the slotted section.

7. A method of making a writing instrument as defined in claim 4 wherein said step of providing a writing instrument having an external surface comprises providing a writing instrument having two external faces thereon having slotted sections formed thereon.

8. A writing instrument comprising:

a main tubular body leaving an external surface of a rectangular configuration, wherein at least one external surface of said rectangular configuration has a slotted section formed therein for receiving a strip of an abrasive material, and said main tubular body has a proximal end and a distal end having a writing point, and a portion towards the distal end that a user grips when using the writing instrument for writing, and the strip of an abrasive material affixed in tie slotted section;

wherein the abrasive material is not located on a cap or clip of the writing instrument.

9. A writing instrument kit comprising:

as a first component, a main tubular body having an external surface of a rectangular configuration, wherein at least one external surface or said rectangular configuration has a slotted section formed therein for receiving a strip of an abrasive material, and said main tubular body has a proximal end and a distal end having a writing point; and a portion towards the distal end that a user grips when using the writing instrument for writing, and as a second component, the strip of an abrasive material in the slotted section;

wherein the abrasive material is not located on a cap or clip of the writing instrument.

* * * * *